US010618341B2

(12) United States Patent
Borgsmüller

(10) Patent No.: US 10,618,341 B2
(45) Date of Patent: Apr. 14, 2020

(54) SECURITY LABEL WITH TILT EFFECT

(71) Applicant: TESA SCRIBOS GMBH, Heidelberg (DE)

(72) Inventor: Stefan Borgsmüller, Heidelberg (DE)

(73) Assignee: TESA SCRIBOS GMBH, Heidelberg (DE)

( * ) Notice: Subject to any disclaimer, the term of this patent is extended or adjusted under 35 U.S.C. 154(b) by 0 days.

(21) Appl. No.: 15/736,513

(22) PCT Filed: Jun. 15, 2016

(86) PCT No.: PCT/EP2016/063716
§ 371 (c)(1),
(2) Date: Dec. 14, 2017

(87) PCT Pub. No.: WO2016/202840
PCT Pub. Date: Dec. 22, 2016

(65) Prior Publication Data

US 2018/0186168 A1 Jul. 5, 2018

(30) Foreign Application Priority Data

Jun. 15, 2015 (DE) ..... 10 2015 210 982

(51) Int. Cl.
*B42D 25/425* (2014.01)
*B42D 25/435* (2014.01)

(52) U.S. Cl.
CPC ..... *B42D 25/425* (2014.10); *B42D 25/435* (2014.10)

(58) Field of Classification Search
CPC ..... B42D 25/425; B42D 25/435
USPC ..... 283/67, 72, 83, 94, 98, 901, 902
See application file for complete search history.

(56) References Cited

U.S. PATENT DOCUMENTS 9,994,062 B2 6/2018 Schilling et al.
2008/0160226 A1* 7/2008 Kaule ..... D21H 21/44 428/29
2012/0193905 A1* 8/2012 Schilling ..... G02B 3/005 283/74

(Continued)

FOREIGN PATENT DOCUMENTS

CN 101120139 2/2008
CN 101905588 A 12/2010

(Continued)

OTHER PUBLICATIONS

English translation of Search Report issued in corresponding Chinese application dated Oct. 15, 2018.
English translation of Search Report dated Apr. 18, 2019.

*Primary Examiner* — Justin V Lewis
(74) *Attorney, Agent, or Firm* — Norris McLaughlin P.A.

(57) ABSTRACT

An anti-counterfeit support with a series of optical security elements (6) and with a metallized layer in which a non-individual pattern (2) with a diffractive surface (3) is in each case embossed for at least two of the optical security elements (6) and in each of which an individual pattern (1) is incorporated by laser lithography, wherein the individual pattern (1) has recesses (4) which form at least a partial pattern of the non-individual pattern (2) and are arranged with precise alignment on the non-individual pattern (2), and the at least two optical security elements (6) each have an optical tilt effect between the individual pattern (1) and the non-individual pattern (2).

14 Claims, 5 Drawing Sheets

(56) References Cited

U.S. PATENT DOCUMENTS

Figure 1B:
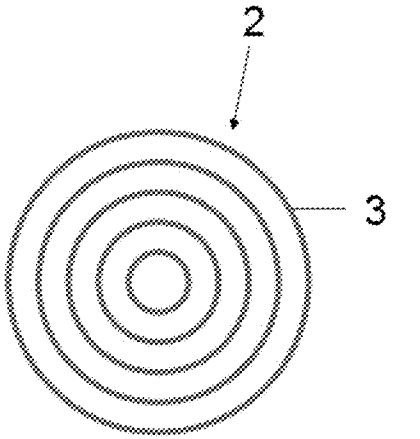

| | | | | |
|---|---|---|---|---|
| 2014/0042738 | A1 | 2/2014 | Power et al. | |
| 2015/0360500 | A1* | 12/2015 | Lok ..... | B42D 25/29<br>349/194 |
| 2018/0264869 | A1 | 9/2018 | Schilling et al. | |

FOREIGN PATENT DOCUMENTS

| | | | |
|---|---|---|---|
| CN | 102497995 | | 6/2012 |
| CN | 103492916 | A | 1/2014 |
| CN | 104023991 | A | 9/2014 |
| CN | 104144796 | A | 11/2014 |
| JP | 2015 074190 | A | 4/2015 |
| WO | 2013 127650 | A1 | 9/2013 |
| WO | 2014/063932 | A1 | 5/2014 |
| WO | 2014 127403 | A1 | 8/2014 |

* cited by examiner

SECURITY LABEL WITH TILT EFFECT

This application is a 371 of International Patent Application No. PCT/EP2016/063716, filed Jun. 15, 2016, which claims foreign priority benefit under 35 U.S.C. § 119 of German Patent Application No. 10 2015 210 982.8, filed Jun. 15, 2015, the disclosures of which are incorporated herein by reference.

The invention relates to an anti-counterfeit carrier having a series of optical security elements. The invention also relates to a method for producing an anti-counterfeit carrier having a series of optical security elements.

Optically variable elements are used for protection against the forgery of products, documents and identity documents. Optical security elements contain structures in very high resolution that produce special optical effects. Such structures are difficult to copy and in most cases cannot be represented by normal printing technology. Optical security elements can contain structures that are visible to, and verifiable by, the naked eye and structures that require simple or special readers to be checked. Optical security elements are largely known and are used in a wide range of applications. Optical security elements include, for example, holograms, kinegrams and lithograms. The structures contained in optically variable elements can be holograms, specifically rainbow holograms, transmission holograms, reflection holograms, 2D holograms, 3D holograms, Fourier holograms, Fresnel holograms, volume holograms and kinoforms. Such holograms can either be directly optically produced or be calculated on a computer. Furthermore, diffractive structures can be contained, in particular diffraction gratings. Refractive structures can be contained, such as Fresnel lenses or blazed gratings. Scattering elements can be contained, such as diffusers. Numerous further structures that can be contained in optically variable elements are described in the literature. The various structures can be partially overlaid so as to be able to accommodate two or more effects in the same region of the optically variable element. The different structures can be used to form graphic elements, such as guilloches, logos, images, lines, areas etc. Furthermore, text elements can be produced, such as lettering, numerical or alphanumerical serial numbers, microprints. Furthermore, functional elements can be formed, such as barcodes or other machine-readable structures. The different structures and elements are cleverly combined to form an overall design for the optical security element that, as far as possible, meets all the requirements of the optical security element with respect to security, functionality and aesthetic impression.

Optical security elements can be produced in a replication process. To this end, a master embossing stamp having a special overall design is established in a complex manner. Such master embossing stamps can be produced in an electron beam lithography method or in a dot matrix method, wherein high resolutions can be achieved. In the case of electron beam lithography, resolutions of up to only a few nanometers can be achieved. In the case of the dot matrix method or other interference methods, diffraction gratings having a grating constant of up to only a few 100 nanometers can be produced. Daughter embossing stamps can in turn be produced from the master embossing stamp, and further daughter embossing stamps from the former. The embossing stamps are then used in an embossing process to emboss a relatively large number of optically variable elements. In such an embossing process, the optically variable elements produced are all substantially identical.

The closest prior art is considered to be the document WO 2013/127650 A1, disclosed in which is an anti-counterfeit carrier having at least one metallized layer into which at least one optically variable element is introduced, wherein the at least one optically variable element has a non-individual embossed structure and the at least one optically variable element has an individual laser-lithographic structure with a resolution of below 20 μm.

The invention is based on the object of rendering carriers having a series of optical security elements even more secure against forgery and to provide a method for their production.

The object with respect to the carrier is achieved by way of an anti-counterfeit carrier having the features of claim 1. Preferred developments are the subject matter of the dependent product claims.

The term carrier is to be understood here in a very general manner. Carriers can be deformable strips, in particular a stripe-type, multi-layer foil, an adhesive strip or stiff strips. What the carriers have in common is that their length and their width are significantly greater than their thickness. The anti-counterfeit carriers according to the invention can adopt a wide variety of forms, in particular can be multi-part, in other words comprise a plurality of individual carrier units. They can be designed in particular as self-adhesive labels or hot-seal material. The label shape or the shape of a hot-seal stamp can be arbitrary, for example circular, oval, polygonal with rounded corners etc. In the case of the hot-seal material, the overall design can also be designed in the form of a long strip that is sealed onto the substrate over its entire length. Such strips are known from entrance tickets, travel tickets or banknotes.

It has surprisingly been found that the security against the forgery of carriers of a series of optical security elements can be increased by adding an optical tilt effect to at least two, a plurality of or each of the optical security elements. This can be done in a manner according to the invention by combining or connecting an embossed structure with a lithographic structure. Arranged along the carrier is a series of optical security elements. A series is here understood to mean at least two optical security elements, but it can also include three, four or any higher number of security elements. They can all be different from one another or some of them can be different. The carrier is preferably dividable between the optical security elements, with the result that each individual optical security element can be used further as an adhesive or hot-sealing label, Holospot®, Priospot®, VeoMark® or the like. In the case of a hot seal foil, dividability is not necessary for further processing in a sealing process.

The carrier has at least one metallized layer, which can be a metallized foil or a metallized lacquer. Other forms of metallized layer also feasible.

The carrier can be first embossed then metallized, or the other way around. The relief of the emboss is here embossed into the metal layer. The metal layer is not destroyed by the embossing and serves as a reflective layer. The light that is diffracted by the embossed structure is reflected back into space. The metallized layer is embossed by embossing a series of non-individual motifs, preferably of mutually identical or at least largely identical motifs. Each of the non-individual motifs forms part of in each case one of the optical security elements. A respective other component of the optical security element is the individual motif. The individual motif differs for each security element in the series.

A series is here understood to be an arrangement. The series can be an arrangement of security elements arranged one next to the other along the carrier. The series has two, three or any higher number of security elements or motifs. The security elements in the series, however, do not need to be arranged immediately next to one another, and instead other security elements can also be arranged within the series. The security elements can be arranged next to one another in a linear manner or in a circular manner or some other way.

The tilt effect between the non-individual motif and the individual motif of each security element manifests in that, at specific viewing angles, the individual motif comes to the foreground for the viewer, and at other viewing angles, the non-individual motif comes to the the foreground for the viewer and appears to be overlaying the individual motif.

A motif is here considered individual if it differs in the series of the optical security elements according to the invention from all motifs of the other security elements or at least from most of them. The individual motifs are different, preferably different in pairs. Such an individual motif can be a serial number or a barcode that contains a serial number, among other things. A non-individual motif is that part of the optical security element that has been embossed by a single master embossing stamp during the production of a series of optical security elements of the non-individual motif. In other words, the non-individual motif is the same or identical in each optical security element. According to the prior art, the non-individual motif of the embossing structure is destroyed or rendered invisible by the individual motif of the lithography structure, because the diffracted light in the locations of the material that are demetallized in the lithographic method is not reflected back. This gives the appearance that the non-individual motif of the embossing structure is overlaid or overprinted by the individual motif of the laser-lithographic structure.

According to the invention, the metallized layer is provided with a diffractive surface structure at a location where the non-individual motif is embossed. Diffractive is to be understood here to mean that the non-individual motif is populated with one or more diffraction gratings along its metallized surface such that, depending on the viewing angle and the illumination, the non-individual motif becomes visible by way of a shimmer. The diffraction gratings generally have grating constants of 400 nm to a few μm to efficiently diffract visible light. The diffractive surface structure thus utilizes the principle of diffraction of the incident light, wherein the light has, depending on the wavelength, diffraction maxima of different orders in different reflection angles, such that when viewing the diffractive surface structure obliquely, a rainbow-type shimmering effect occurs at viewing angles that coincide with the diffraction angles, but not at all viewing angles.

According to the invention, the non-individual motif is overlaid with an individual motif in the same metallized layer. An individual motif is introduced by laser lithography into the metallized layer, and the individual motif has cutouts that are preferably not processed by laser lithography. The cutouts form at least a partial motif, but possibly even the entire non-individual motif, and the cutouts are arranged in register on the individual motif.

In register is here understood to mean that the individual and the non-individual motifs of a security element are arranged exactly, or exactly save for register deviations, with respect to one another. The motifs can here be offset relative to one another from security element to security element at most by the register deviation. The magnitude of the register deviation, which is also referred to as register offset, will be explained further below.

In laser lithography, a structure to be exposed is transferred into a substrate using a laser beam. The structure to be exposed is specified or calculated using a computer and is present in the form of image or vector data. The image or vector data are used by the laser lithography apparatus for controlling the position of the laser beam relative to the substrate and for controlling the intensity and the duration of action of the laser beam that is incident on the substrate. In laser lithography, several methods have become established. For one, a writing beam can be fixed in space and the substrate can be moved relative thereto. Alternatively, the substrate can be fixed in space and the writing beam can be moved relative thereto. Furthermore, both substrate and laser beam can be moved. It is also possible for the writing beam to be modulated using a spatial light modulator and to expose a relatively large area of the substrate at once in this way. In this principle, writing beam and substrate can also be moved.

In laser lithography, the resolution is limited by the wavelength used and by the optical unit used. In order to be able to produce structures with as high a resolution as possible, small wavelengths are therefore used with preference. Suitable wavelengths are in the range of 0.2 μm to 10 μm, preferably in the range of 0.2 μm to 1 μm. Smaller wavelengths are likewise possible. At these wavelengths, structures can be produced that are effective in the range of the visible light (wavelength approximately 0.4 μm to 0.7 μm). Diffraction gratings having grating constants in the order of magnitude of the visible light can be produced in this way, which have large diffraction angles and can therefore be perceived particularly well.

Optical security elements produced using laser lithography can be fully individualized in terms of design during production. All structures can be configured individually. This can be done using numerical or alphanumerical serial numbers or by way of individual graphic elements such as images or guilloches.

Substrate materials used for laser lithography are, as in the embossed optical security elements, metallized foils or metallized lacquers, among others. In this case, the laser beam can be set in terms of wavelength, intensity, pulse duration, shape and writing energy such that the substrate material becomes demetallized at specific predefined locations and as a result becomes transparent or semi-transparent. This is done either by ablating the metal layer, by displacing the metal layer towards the edges of the exposed location or by converting the metal layer into a transparent or semi-transparent oxide layer. A mixture of the three stated effects can also take place. The demetallization can be aligned in register with the other structures which can be produced by laser lithography, because it can be introduced in the same exposure process. Since demetallization in laser lithography is effected in principle with the high resolution of the laser lithographic process, highly resolved demetallized structures can be produced therewith. This includes microprint, scattering structures, gray levels or gray-level wedges. Such gray levels can be produced by suitable rasterization in a halftone method, wherein only a specific portion of the area is demetallized in rasterized fashion in an area. In the case of gray-level wedges, the demetallized area portion gradually increases in the area by adapting the rasterization.

In addition to complete demetallization, reducing the thickness of the metal layer is also possible in laser lithography by exactly setting the laser energy introduced during the writing process. By reducing the thickness of the metal layer, the light transmittance of the metal layer increases. This can also be used to produce gray levels and gray wedges.

The production of optical security elements with highly resolving laser lithography is subject to certain limitations. For example, the base resolution is limited by the wavelength used of the writing laser and by the optical unit used. Since in mass production, high writing speeds and thus a high throughput are intended to be achieved, it is desirable to further reduce the resolution since in that case larger areas can be exposed in shorter time periods. Typical base resolutions used here are 0.5 μm to 5 μm. In laser lithography, a limited resolution should thus be assumed. When producing diffracting structures, such as e.g. gratings or holograms, not all diffraction angles can be achieved due to the limited resolution. Furthermore, the phase or amplitude modulation to be achieved with laser lithography in the material is not ideal, such that the theoretically maximum possible diffraction efficiency of the diffractive structures is not achieved.

The individual motif is produced here for example such that the regions that make up the individual motif are processed by laser lithography such that the metallized layer is demetallized. As a result, the motif becomes transparent, and dark or different-colored areas located under the metal layer can optically come to the fore, with the result that, when the optical security element is viewed, the individual motif is recognizable in principle. According to the invention, however, the individual motif has cutouts. These are regions that are not processed by laser lithography, in other words they continue to be metallized and thus reflect the incident light. The idea here is that the cutouts occupy exactly those areas that are not used by the non-individual motif of the embossed structure. As a result, the at least one optical security element is formed by a stacked arrangement of the non-individual motif with the individual motif.

The non-individual motif preferably has fine lines. Fine is to be understood here to mean that the width of the line is less than 250 μm, preferably between 50 μm and 100 μm. The line width is selected such that the lines are still sufficiently wide to receive a diffractive structure and also to produce a diffraction effect. The area occupied by the non-individual motif should be small, preferably less than 25%. The diffractive surface structure of the metallized layer preferably remains completely unchanged even by the individual motif that has been applied by laser lithography.

The non-individual motif can be a pattern of fine lines, such as concentric rings or a diamond pattern. The non-individual motif can be a letter, a word, a logo or a symbol. If the motif contains larger areas, only the outlines of these areas should form the motif, so that the motif overall is made up only of fine lines.

The invention is based on both the non-individual motif and the individual motif remaining recognizable in at least one optical security element. Due to the above-described arrangement, surprisingly a type of tilt effect occurs for the viewer of the optical security element. At a viewing angle and illumination at which the non-individual motif of the embossed structure does not shimmer, the individual motif of the laser-lithographic structure comes to the foreground and is readable by a human viewer almost in a disruption-free manner, as if the cutouts were not present. This is because the cutouts are practically not noticeable to the viewer due to the low line width of the non-individual motif.

However, at a viewing angle and illumination at which the non-individual motif of the embossed structure does shimmer, the non-individual motif of the embossed structure comes to the foreground and, to the human viewer, appears to be located over the individual motif of the laser lithographic structure. The two views are swapped when the optical security element is tilted.

In order to produce the anti-counterfeit carrier according to the invention having at least one optical security element, a resolution of a laser lithographic method is necessary to be able to apply the cutouts in the order of magnitude of less than 250 μm, and also very good registration accuracy between the non-individual motifs and the individual motifs is necessary. To this end, the position of the non-individual motif must be marked during the production method, e.g. using a registration mark, and the individual motif must be introduced into the metallized layer in exact register according to the marked position using the laser lithographic method.

If the registration accuracy is not present during production, the non-individual motif is partially destroyed or rendered invisible by the individual motif of the laser lithographic method, and the tilt effect is not, or at least not fully, effective. During production, production tolerances may occur, i.e. slight register offsets between the non-individual motif of the embossed structure and the individual motif of the laser lithographic structure can destroy the tilt effect. Such production tolerances are preferably taken into consideration when designing the security elements.

If the maximum register deviation of the production process between the two motifs is known, the maximum register deviation can be added to the line width of the non-individual motif of the embossed structure. The line width is increased by the absolute value of the maximum deviation. The cutouts of the laser lithographic structure, however, retain their original width, i.e. are designed as if the lines of the non-individual motif of the embossed structure had not been widened. If during the production method the position of the individual motif of the laser lithographic structure deviates from the position of the non-individual motif of the embossed structure, then the line of the non-individual motif of the embossed structure is still present at the cutouts. The tilt effect continues to be effective. A disadvantage of this is of course that the lines are widened. It is still possible with this method and the widening of the lines to compensate for minor register deviations. The register deviations should be in the range of +/−100 μm, preferably +/−50 μm.

To take into consideration the production tolerances when designing the motifs, alternatively the register deviation is added to the width of the cutouts of the laser lithographic structure. If during the production method the position of the individual motif of the laser lithographic structure deviates from the position of the non-individual motif of the embossed structure, then the line of the non-individual motif of the embossed structure is still present at the larger cutouts. The tilt effect continues to be effective here as well.

The high resolution of the laser lithography method and the high demands in terms of registration accuracy represent a significant obstacle to forging the optical security elements.

With respect to the method, the object is achieved by way of a method having the features of claim 11.

The object is achieved by way of a method for producing an anti-counterfeit carrier having at least one optical security element by the optical security element producing an optical tilt effect by way of a non-individual motif being embossed into a metallized layer, and by a diffractive surface structure being produced on the non-individual motif in the process, and by an individual motif being introduced into the metallized layer by laser lithography, and by cutouts being produced in the individual motif in the process that form at least a partial motif of the non-individual motif. The cutouts are arranged in exact register on the non-individual motif. Here, initially a non-individual motif is embossed into the metallized layer, for example in the form of concentric rings, another mathematical pattern or a logo. A stamp is used herefor, preferably a master embossing stamp, which continuously embosses, for example, non-individual motifs into the metallized layer along an elongate carrier at specific intervals. The stamp is here designed exactly such that a surface structure is introduced in the metallized layer that produces a diffraction grating in visible light or an overlay of a plurality of diffraction gratings in visible light. The diffraction grating produces a shimmering effect and causes the non-individual motif to become visible at specific viewing angles that correspond to the diffraction angle of different orders.

Preferably, a further, but individual motif is subsequently burned into the same metallized layer by laser lithography. However, the metallized layer is treated by laser lithography such that the surface structure of the non-individual motif remains intact and at the same time only the interspaces between the concentric lines or other lines of the non-individual motif are treated by laser lithography. The lines of the individual motif and the areas of the individual motif that are treated by laser lithography have significantly greater dimensions, i.e. in the millimeter range, and are thus dominantly visible when viewing the optical security element outside the diffraction angles.

Figure 3:
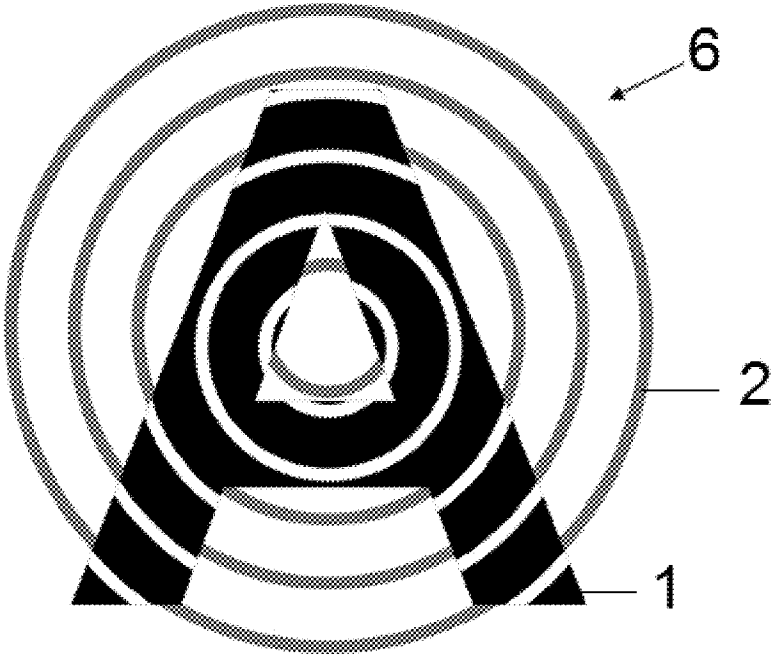

The invention will be described on the basis of four exemplary embodiments in 17 figures, in which:

FIGS. 1*a* to 1*d* show a basic principle of a construction of an anti-counterfeit carrier according to the invention having an optical security element, FIGS. 2*a* to 2*d* show an optical security element consisting of a QR code and concentric rings, FIG. 3 shows a non-individual motif and an individual motif, arranged one above the other, with a register offset, FIGS. 4*a* to 4*d* show a carrier having a security element with a non-individual motif, the concentric rings of which are wider than the width of the cutouts of the individual motif, FIGS. 5*a* to 5*d* show a carrier having a security element with an individual motif, the cutouts of which are wider than the concentric rings of the non-individual motif.

FIGS. 1*a* to 1*d* show different motifs 1, 2 that are introduced on top of one another in a metallized layer. The metallized layer and a carrier for the metallized layer are not illustrated in the figures.

Figure 1D:
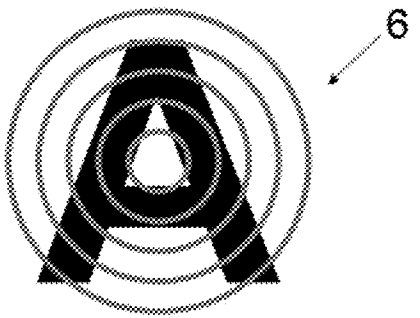
Figure 1A:
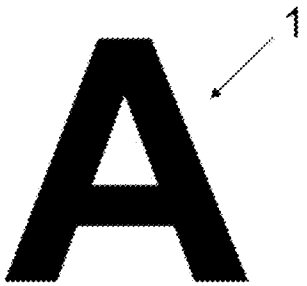

FIG. 1*a* shows an individual motif 1 in the form of the letter "A," which is intended to be introduced into the metallized layer in a conventional laser lithography process.

FIG. 1*b* shows a non-individual motif 2 in the form of five concentric rings in each case having a line width of 220 μm, which are formed in the same metallized layer in a conventional embossing process. Moreover, during the embossing of the non-individual motif 2 into the metallized layer, a diffractive surface 3 is produced on the metallized layer (not illustrated). This diffractive surface 3 is characterized in that one or more diffraction gratings for visible light are formed on the surface of the metallized layer in the region of the non-individual motif 2. The diffraction gratings generally have grating constants of 400 nm up to several μm to efficiently diffract visible light. The depths of the diffraction gratings are generally several 100 nm.

Figure 1C:
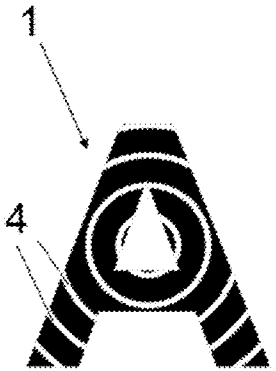
Figure 2A:
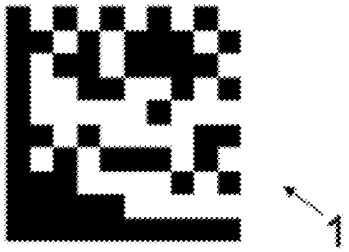
Figure 2B:
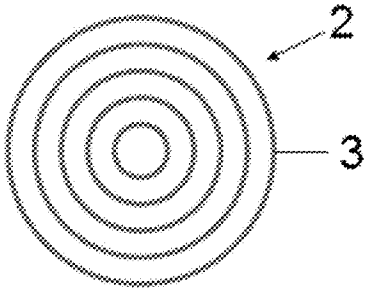
Figure 2C:
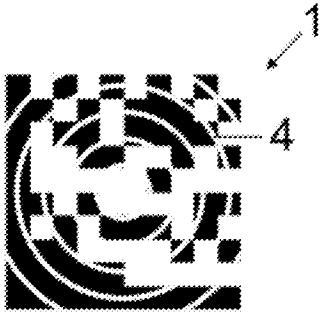
Figure 2D:
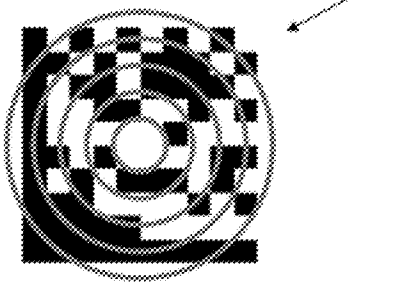

FIG. 1*c* shows the individual motif 1 that has been introduced into the metallized layer with cutouts 4. The cutouts 4 are formed as portions or parts of the five concentric rings, and the partial motif of the five concentric rings corresponds exactly to a partial motif of the five concentric rings of the non-individual motif 2, which are illustrated in FIG. 1*b*.

In FIG. 1*c*, the dark areas of the letter "A" have been treated by laser lithography, the cutouts 4 and the region around the letter "A" and the internal triangle of the letter "A" have not been treated by laser lithography, i.e. the non-treated areas of the individual motif 1 are still metallized, and the dark areas treated by laser lithography are demetallized and do not reflect incident light. In FIG. 1*c*, they are shown in white. When a viewer views the metallized layer from the outside, the demetallized areas of the individual motif 1 appear in the color of the background of the layer, because the metal layer becomes transparent in this region. With preference, a high-contrast, dark background is used. Since the demetallized areas are significantly larger than the cutouts 4 which remain metallized, the letter "A" continues to be clearly recognizable.

FIG. 1*d* shows the overlay of the two motifs 1, 2 in the same metallized layer. The non-individual motif 2 of the embossed structure with the five concentric rings and the individual motif 1 of the lithographic structure with the letter "A" and the cutouts 4 are matched in exact register with respect to one another such that the cutouts 4 are filled exactly by the associated portions of the five concentric rings. The overlaid non-individual motif and the individual motif 2, 1 according to FIG. 1*d* are together introduced into the carrier as an optical security element 6. The letter "A" can be varied as an individual motif 1 for every further optical security element 6 in a sequence, while the non-individual motifs 2, the five concentric rings, remain the same for each of the optical security elements 6 in the sequence.

If the optical security element 6 according to FIG. 1*d* is viewed with the naked eye, the non-individual motif 2 of the embossed structure appears to shimmer in the foreground if the security element 6 is viewed under corresponding illumination and at a corresponding angle. The five concentric rings shimmer. If the security element 6 is viewed at an angle that does not correspond to the diffraction angle of the diffractive surface 3, the laser lithographic individual motif 1 appears to be in the foreground, as it has a significantly higher contrast and is more prominent than the non-individual motif 2 which does not shimmer outside any of the diffraction angles. The gaps and/or cutouts 4 of the laser lithographic individual motif 1 are not noticeable, because the cutouts 4 are very fine and are less than 250 μm in terms of width, preferably of each width, along the radial circumference thereof. Since the shimmer of the non-individual motif 2 is dependent on the illumination and viewing angles, a tilt effect between the two motifs 1, 2 can be achieved by tilting the optical security element 6.

FIGS. 2*a* to 2*d* show an arrangement as in FIGS. 1*a* to 1*d*, except here the individual motif 1 is in the form of a data matrix code. The non-individual motif 2 is again an arrangement of five concentric rings. The tilt effect and the production method correspond to those of FIGS. 1*a* to 1*d*. As for the rest, identical reference signs correspond to identical features.

FIG. 3 schematically illustrates the principle problem of tolerances of the embossing and of the lithography methods. To produce the security element 6, typically, for example, the embossing structure is initially embossed at spaced intervals along the carrier into the metallized layer, and thus a series of identical non-individual motifs 2 is produced. Next, an individual motif 1 having the corresponding cutouts 4 is applied by laser lithography on the non-individual motifs 2 in the already processed carrier. The laser lithographic method must of course be performed with exact register on the non-individual motifs 2. Exact registration accuracy, however, is practically not achievable, and as a result, once the laser lithographic method has been performed, typically the optical security element 6 according to FIG. 3 is produced, in which an offset between the individual motif 1 and the non-individual motif 2 occurs, i.e. the five concentric rings are arranged not exactly in the cutouts 4 of the individual motif 1, but with a slight offset. The tilt effect, however, no longer works in this case.

FIG. 4*a* to FIG. 4*d* show a first possible way of compensating the register deviation by way of the described production tolerances. Typically, during the embossing method, registration marks are arranged at the edge of the carrier structure, and the registration marks are read during the subsequent laser lithographic process and the laser lithographic process is exactly aligned on the basis of the registration marks, and yet production tolerances occur, as illustrated in FIG. 3.

Figure 4A:
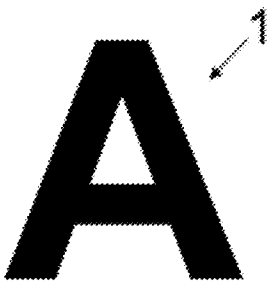
Figure 4B:
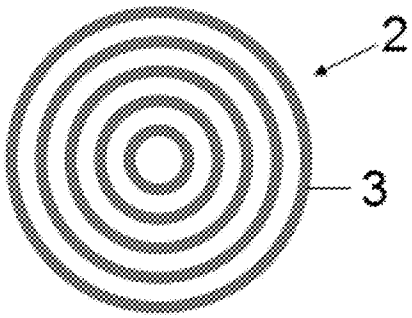
Figure 4C:
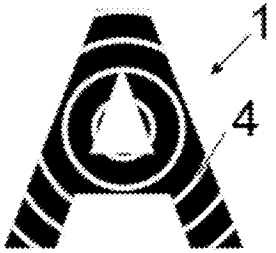
Figure 4D:
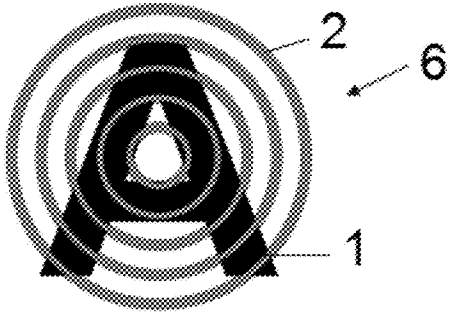
Figure 5A:
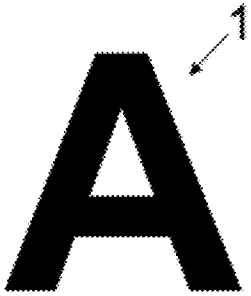
Figure 5B:
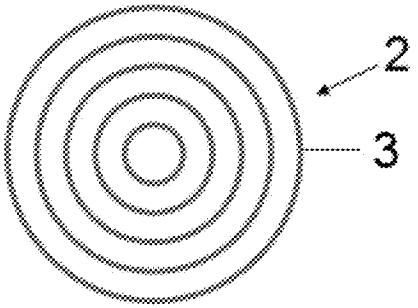
Figure 5C:
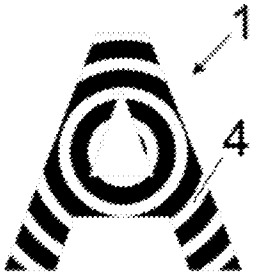
Figure 5D:
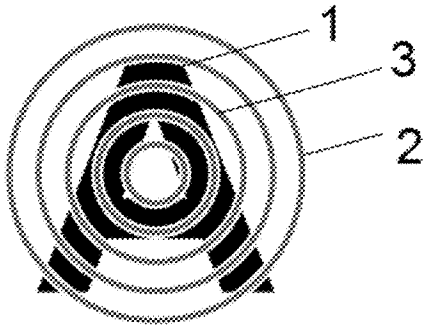

In order to still produce the tilt effect according to the invention, the lines of the non-individual motif 2 are uniformly widened around a register deviation along their entire perimeter. The lines which have been widened by the register deviation are illustrated in FIG. 4*b*. The laser lithographic individual motif 1 according to FIG. 1*a* and FIG. 1*c* is produced in the laser lithographic process mentioned in the introductory part with an ideal width of the cutouts 4. If the two motifs 1, 2 are arranged one above the other, the diffractive surfaces 3 of the non-individual motifs 2 according to FIG. 4*d* still completely appear in the cutouts 4 of the individual motif 1 despite the register deviation. The different line thicknesses inside and outside the laser lithographic individual motif 1 are not noticeable to the viewer.

FIGS. 5*a* to 5*d* illustrate an alternative embodiment of the optical security element 6 according to the invention, in which the register deviation of the laser lithographic process is likewise taken into consideration by the embossing process. Here, in contrast to FIGS. 4*a-d*, it is not the lines of the non-individual motif 2 that are widened in accordance with FIG. 5*b*, but the cutouts 4 of the laser lithographically produced individual motif 1 are widened by the register deviation in FIG. 5*c*, with the result that, according to FIG. 5*d*, the five concentric rings and thus the diffractive surface 3 are still completely contained in the cutouts 4 and remain visible and thus produce the desired tilt effect, even if there is a deviation or an offset between the motifs 1, 2.

LIST OF REFERENCE SIGNS

1 individual motif
2 non-individual motif
3 diffractive surface
4 cutouts
6 optical security element

The invention claimed is:

1. An anti-counterfeit carrier having a series of optical security elements introduced into a metallized layer, at least two of the optical security elements introduced into the metallized layer each comprising an embossed non-individual motif with a diffractive surface, and each of the optical security elements introduced into the metallized layer comprising an individual motif introduced by laser lithography, wherein the individual motif has cutouts that form at least a partial motif of the non-individual motif and are arranged in exact register with respect to the non-individual motif, and said at least two optical security elements have an optical tilt effect between the individual motif and the non-individual motif.

2. The anti-counterfeit carrier as claimed in claim 1, wherein, due to the tilt effect, the individual motif comes to a foreground of the optical security elements at specific viewing angles and the non-individual motif comes to the foreground of the optical security elements at other viewing angles and appears to be overlaying the individual motif.

3. The anti-counterfeit carrier as claimed in claim 1, wherein the non-individual motif has fine lines.

4. The anti-counterfeit carrier as claimed in claim 3, wherein a width of the fine lines is less than 250 μm.

5. The anti-counterfeit carrier as claimed in claim 1, wherein the cutouts are widened by a value of a register deviation.

6. The anti-counterfeit carrier as claimed in claim 1, wherein lines of the non-individual motif are widened by a value of a register deviation.

7. The anti-counterfeit carrier as claimed in claim 1, wherein the non-individual motif comprises a logo, a drawing, lettering, a symbol or a pattern.

8. The anti-counterfeit carrier as claimed in claim 1, wherein the individual motif is text, a serial number, or part of a serial number.

9. The anti-counterfeit carrier as claimed in claim 1, wherein the individual motif is a barcode, a data matrix code, or a QR code.

10. The anti-counterfeit carrier as claimed in claim 1, wherein the non-individual motifs in the series are identical and the individual motifs in the series differ from one another.

11. A method for producing an anti-counterfeit carrier having a series of optical security elements, of which at least two produce an optical tilt effect, said method comprising embossing non-individual motifs into a metallized layer and producing a diffractive surface on the non-individual motifs, introducing individual motifs into the metallized layer by laser lithography and producing cutouts in the individual motifs that each form at least a partial motif of the non-individual motif and are arranged in exact register on the non-individual motif.

12. The method as claimed in claim 11, wherein the cutouts are widened by a value of a register deviation.

13. The method as claimed in claim 11, wherein lines of the non-individual motif are widened by a value of a register deviation.

14. The method as claimed in claim 11, wherein the non-individual motifs are produced in a mass replication method using a master stamp.

* * * * *